US008960659B2

(12) United States Patent
Hunkeler et al.

(10) Patent No.: US 8,960,659 B2
(45) Date of Patent: Feb. 24, 2015

(54) METHOD FOR PRODUCING PRINTED PRODUCTS CONSISTING OF AT LEAST THREE SUB-PRODUCTS

(75) Inventors: Franz Hunkeler, Zofingen (CH); Kurt Graber, Brittnau (CH)

(73) Assignee: Hunkeler AG, Wikon (CH)

( * ) Notice: Subject to any disclaimer, the term of this patent is extended or adjusted under 35 U.S.C. 154(b) by 0 days.

(21) Appl. No.: 14/357,727

(22) PCT Filed: Nov. 10, 2011

(86) PCT No.: PCT/CH2011/000270

§ 371 (c)(1),
(2), (4) Date: May 23, 2014

(87) PCT Pub. No.: WO2013/067650

PCT Pub. Date: May 16, 2013

(65) Prior Publication Data

US 2014/0306439 A1 Oct. 16, 2014

(51) Int. Cl.

| | |
|---|---|
| ***B42C 3/00*** | (2006.01) |
| ***B42D 1/04*** | (2006.01) |
| ***B42C 19/06*** | (2006.01) |

(Continued)

(52) U.S. Cl.

CPC ... *B42D 1/04* (2013.01); *B42C 3/00* (2013.01); *B42C 19/06* (2013.01); *B42D 15/008* (2013.01); *B65H 37/04* (2013.01); *B65H 45/28* (2013.01); *B65H 45/30* (2013.01); *B42C 9/0006* (2013.01)

USPC ..... 270/52.09; 270/52.07; 270/8; 270/5.02

(58) Field of Classification Search

CPC ..... B42C 3/00

USPC ..... 270/52.09, 5.02, 5.01, 8, 52.07, 52.08

See application file for complete search history.

(56) References Cited

U.S. PATENT DOCUMENTS 3,730,512 A * 5/1973 Bellanca ..... 412/6
4,279,409 A * 7/1981 Pemberton ..... 270/5.02

(Continued)

FOREIGN PATENT DOCUMENTS

EP 0 814 044 A1 12/1997
GB 2 257 090 A 1/1993

OTHER PUBLICATIONS

May 13, 2014 Written Opinion of the ISA issued in International Application No. PCT/CH2011/000270.

*Primary Examiner* — Patrick Mackey
(74) *Attorney, Agent, or Firm* — Oliff PLC

(57) ABSTRACT

In a first step, in a printed material web (1) moved in a feed direction, a first material web part (5) which is formed by a material web section (1*a*)is folded against the rest of the material web (6) that is formed from two material web portions (1*b*, 1*c*)).In the region of a connecting line (2*b*) extending between neighbouring material web sections (1*b*, 1*c*) the two material web parts (5,6) are connected to one another by a means of a bonding adhesive. In a subsequent step the material web (1) is folded again along a line (2*b*) extending between two neighbouring material web sections. (1*b*, 1*c*)All material web sections (1*a*, 1*b*, 1*c*) lie above one another. Subsequently, multi-page sub-products (11), the pages (12*a*, 12*b*, 12*c*) of which are connected to one another in the region of the spine (13) of the sub-product, are separated from the twice-folded material web (1). Finally, the sub-products (11) are placed on top of one another to form a stack (16) and are connected to one another in the region of the spine (13) thereof by means of a bonding adhesive.

24 Claims, 9 Drawing Sheets

Figure 1:
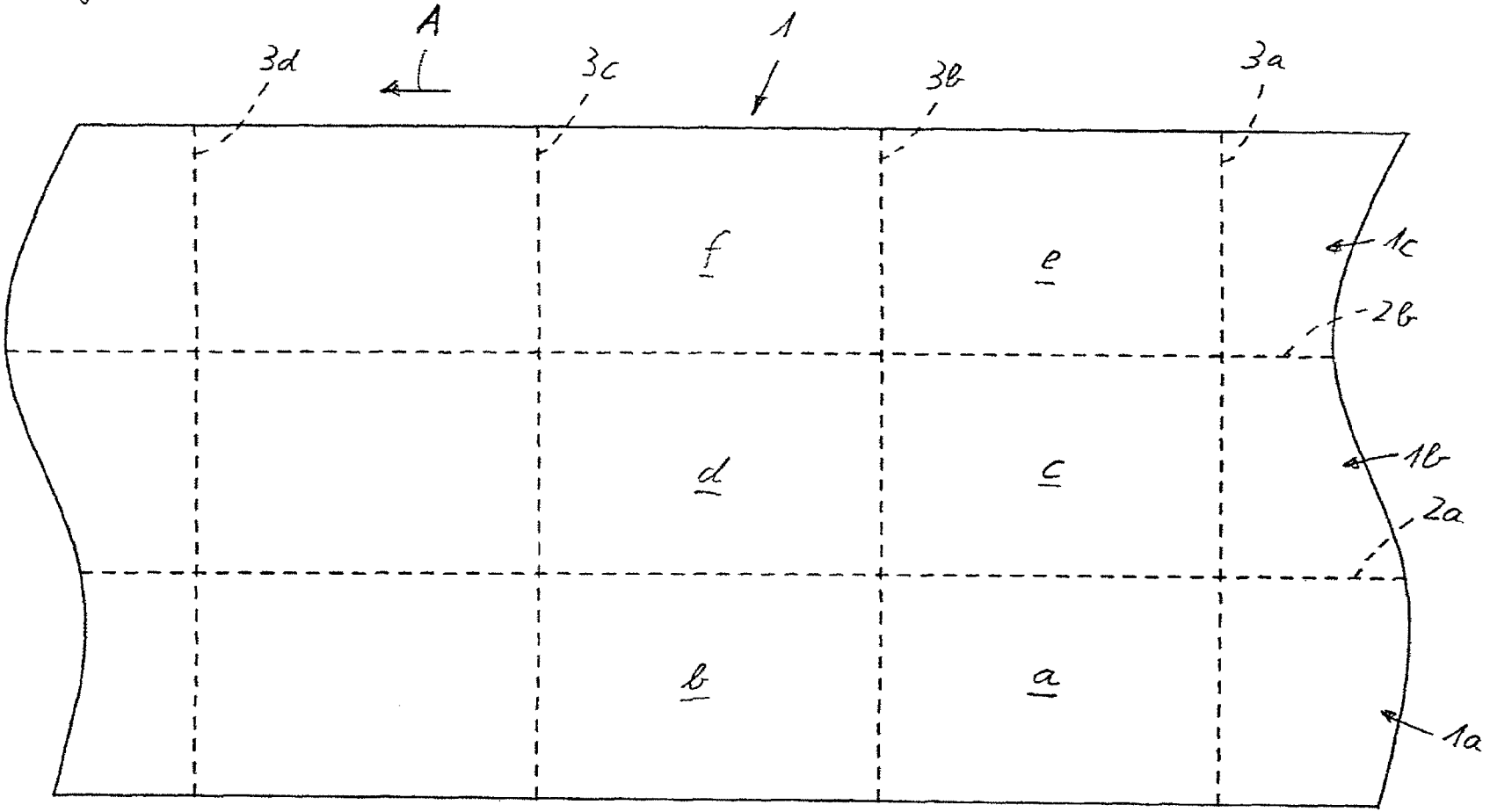

(51) Int. Cl.

| | |
|---|---|
| ***B42D 15/00*** | (2006.01) |
| ***B65H 37/04*** | (2006.01) |
| ***B65H 45/28*** | (2006.01) |
| ***B65H 45/30*** | (2006.01) |
| ***B42C 9/00*** | (2006.01) |

(56) References Cited

U.S. PATENT DOCUMENTS

| | | | | |
|---|---|---|---|---|
| 4,939,888 | A * | 7/1990 | Katz et al. | 53/411 |
| 5,296,066 | A * | 3/1994 | Dahlquist | 156/201 |
| 6,139,003 | A * | 10/2000 | Michalik et al. | 270/52.17 |
| 6,896,250 | B2 * | 5/2005 | Hillebrand | 270/52.09 |
| 7,364,148 | B2 * | 4/2008 | Herbert et al. | 270/52.09 |
| 7,556,247 | B1 * | 7/2009 | Delfer et al. | 270/21.1 |
| 7,631,857 | B2 * | 12/2009 | Hunkeler et al. | 270/5.03 |
| 7,878,494 | B1 * | 2/2011 | Volkert | 270/21.1 |
| 8,002,257 | B2 * | 8/2011 | Dawley et al. | 270/52.17 |
| 2001/0040371 | A1 | 11/2001 | Dahlquist | |
| 2007/0062392 | A1 * | 3/2007 | Ratz | 101/227 |
| 2009/0127763 | A1 * | 5/2009 | Cossette | 270/21.1 |

* cited by examiner

METHOD FOR PRODUCING PRINTED PRODUCTS CONSISTING OF AT LEAST THREE SUB-PRODUCTS

The invention relates to a method for producing printed products, in particular books, brochures and the like, which consists of at least three multiple-sheet sub-products which lie on one another and are connected to one another, in accordance with the preamble of claim 1, and to printed products which are produced in accordance with said method.

A method of this type is described in EP 2 145 773 A1. In this known method, the starting point is a material web which has been printed in a digital printing station and which is divided into three or four printed material web sections which are arranged next to one another and extend in the longitudinal direction of the material web. In a first method step, in the case of the material web which is advanced in an advancing direction, a first material web part which is formed by at least one of the material web sections is collated with the remaining material web part which is formed from at least one of the remaining material web sections. The two material web parts are then connected to one another by means of an adhesive along a line which runs between two adjacent material web sections. Subsequently, sub-products are separated from the material web, which sub-products are then stacked to form a stack. During stacking, each sub-product is connected by means of an adhesive to the sub-product which was previously placed onto the stack. In order to obtain the printed product which consists of the sub-products, the sub-products which are stacked and are connected to one another are folded about a line which coincides with the center line of the stack which consists of the sub-products.

EP 2 159 070 A1 has disclosed a method for producing book blocks, in which method sheets are cut from a material web which is printed in a digital printing station, which sheets are folded and subsequently placed on one another to form a stack which forms in each case one book block. Before or while they are placed on one another, adhesive is applied to the folded sheets in a manner which is adjacent to that side edge which comes to lie in the spine of the book block. The sheets in the stack, that is to say in the book block, are connected to one another by means of said applied adhesive. The book blocks which consist of sheets which are adhesively bonded to one another are finally mounted in a cover.

WO 02/40282 describes a method for producing an end product which consists of printed individual sheets. In a first step, a two-component adhesive is applied to the individual sheets in the region of a side edge of said individual sheets. The individual sheets are then placed on one another to form a stack in such a way that the adhesive applications lie above one another. Subsequently, pressing of the stack which consists of individual sheets takes place in the region of that side edge, along which the adhesive applications are situated.

WO 2005/072980 A2 has disclosed a method for producing bound printed products. In this method, individual sheets are separated from a material web which has been printed on both sides in a digital printing station, which individual sheets are then pre-folded and are provided with an adhesive application along their folding line. The sheets are then placed above one another in a straddling manner to form a stack. The finished stacks are fed to a further processing station, in which the trimmed stacks are stacked to form an end product, the individual stacks being connected to one another by means of an adhesive.

The present invention is now based on the object of providing a method of the type mentioned at the outset, which method makes it possible, with as little complexity and expense as possible, to produce finished printed products which consist of a plurality of multiple-sheet sub-products which lie on one another and are connected to one another.

According to the invention, this object is achieved by way of a method having the features of claim 1. A printed product which is produced in accordance with said method is distinguished by the features of claim 22.

By way of various processing operations on the advanced material web (folding, separating and placing on one another of material web sections, application of adhesive), the various material web sections are placed on one another and are connected to one another in such a way that, subsequently, sub-products can be separated which consist of a plurality of printed sheets which are connected to one another at the spine via a fold or an adhesive connection. The finished printed product is obtained by virtue of the fact that said sub-products which are also trimmed at any rate on their side edge which lies opposite the binding are placed on one another to form a stack and are connected to one another by means of an adhesive in the region of their spine.

Preferred developments of the method according to the invention and the printed product according to the invention are defined in the dependent claims and described in the description of the figures.

Figure 2:
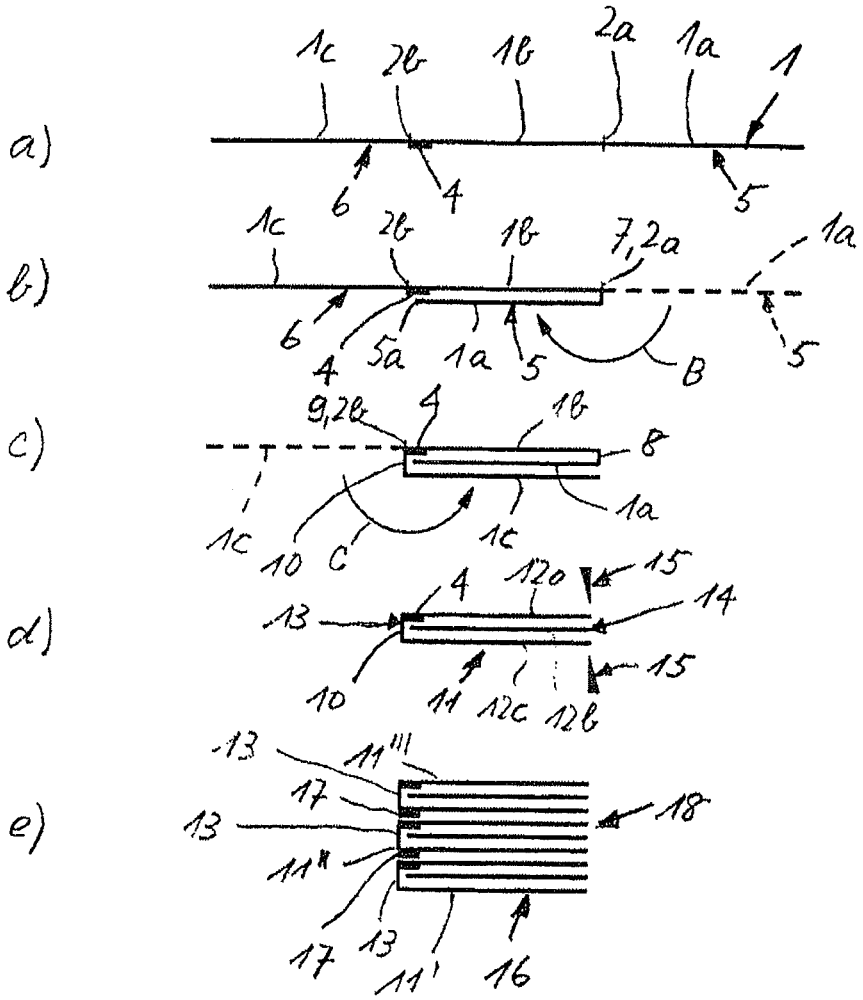
Figure 3:
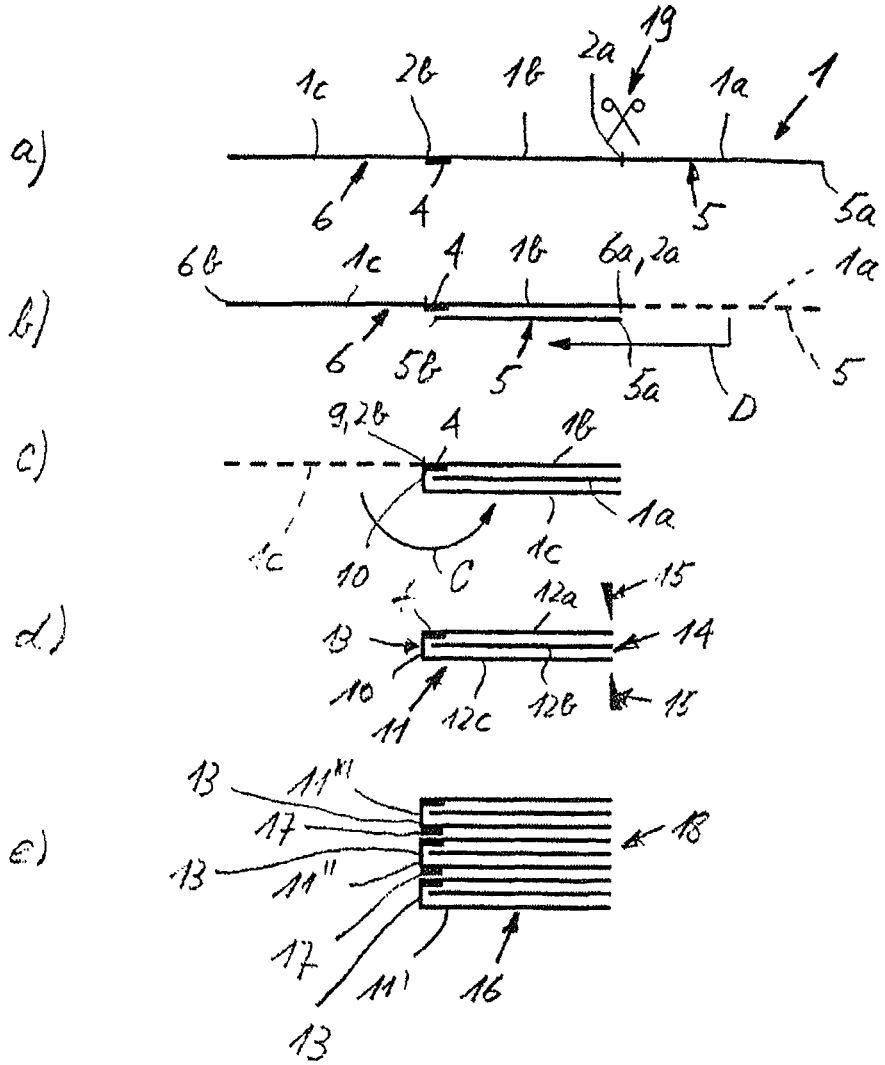
Figure 4:
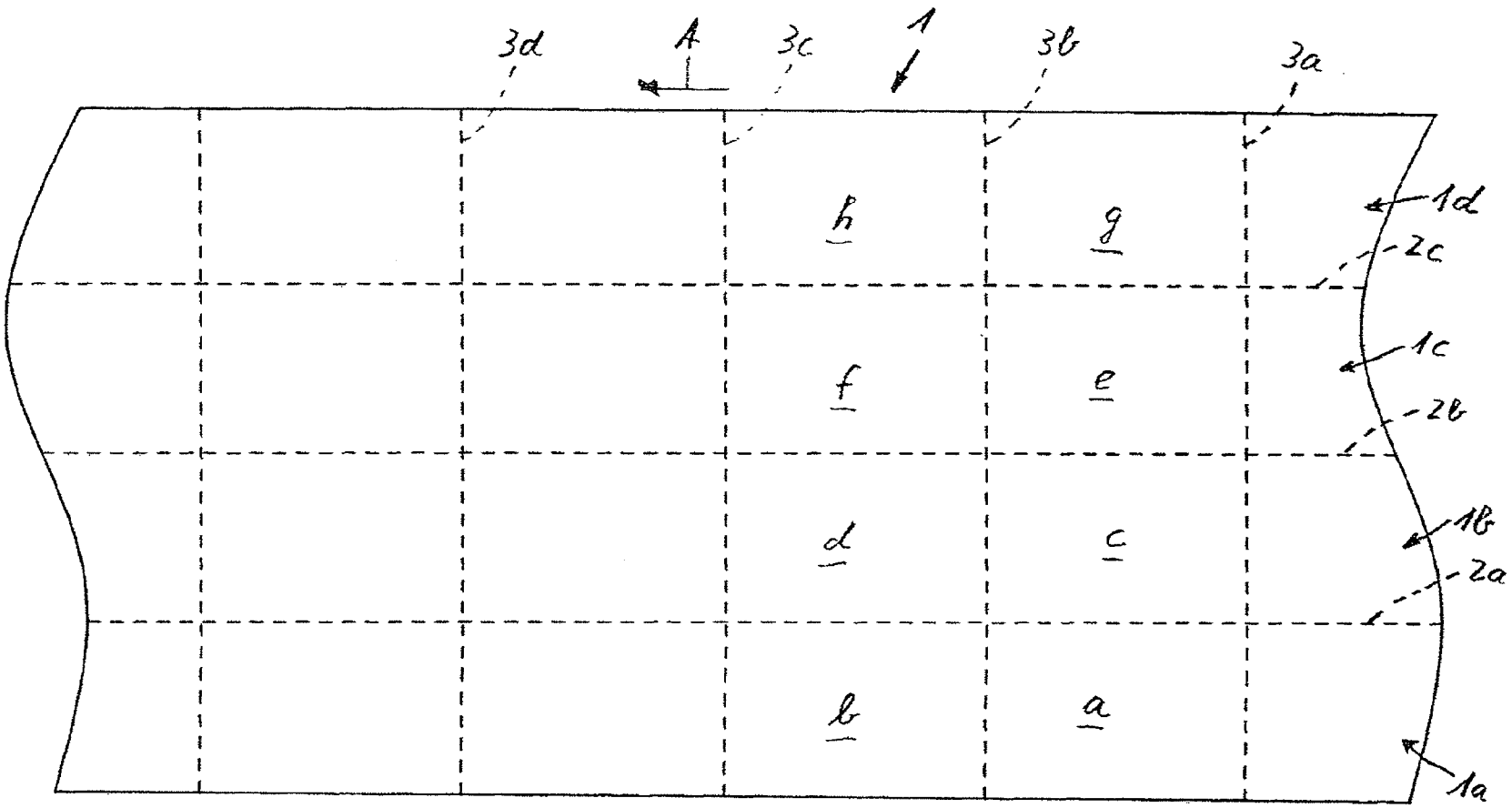
Figure 5:
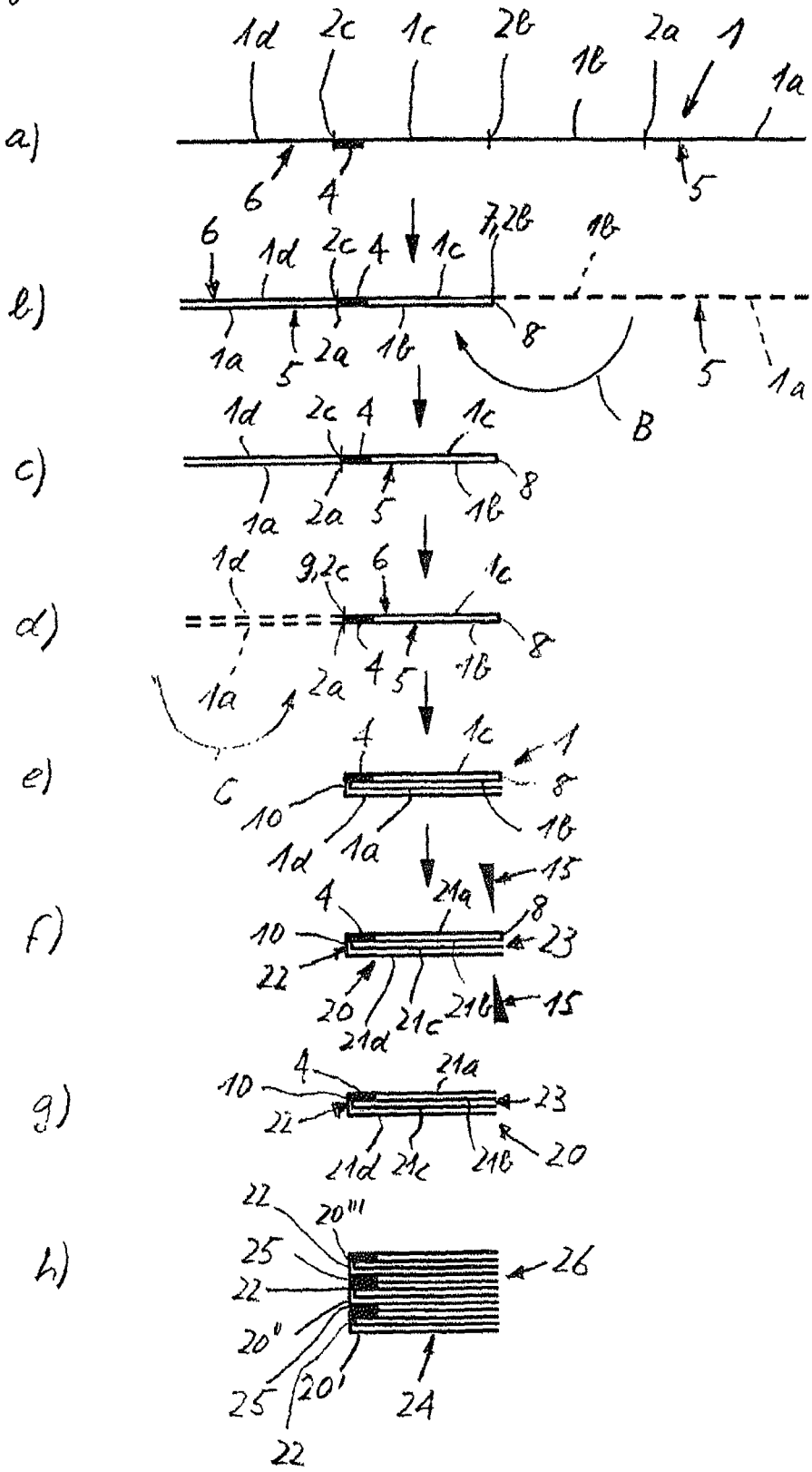
Figure 6:
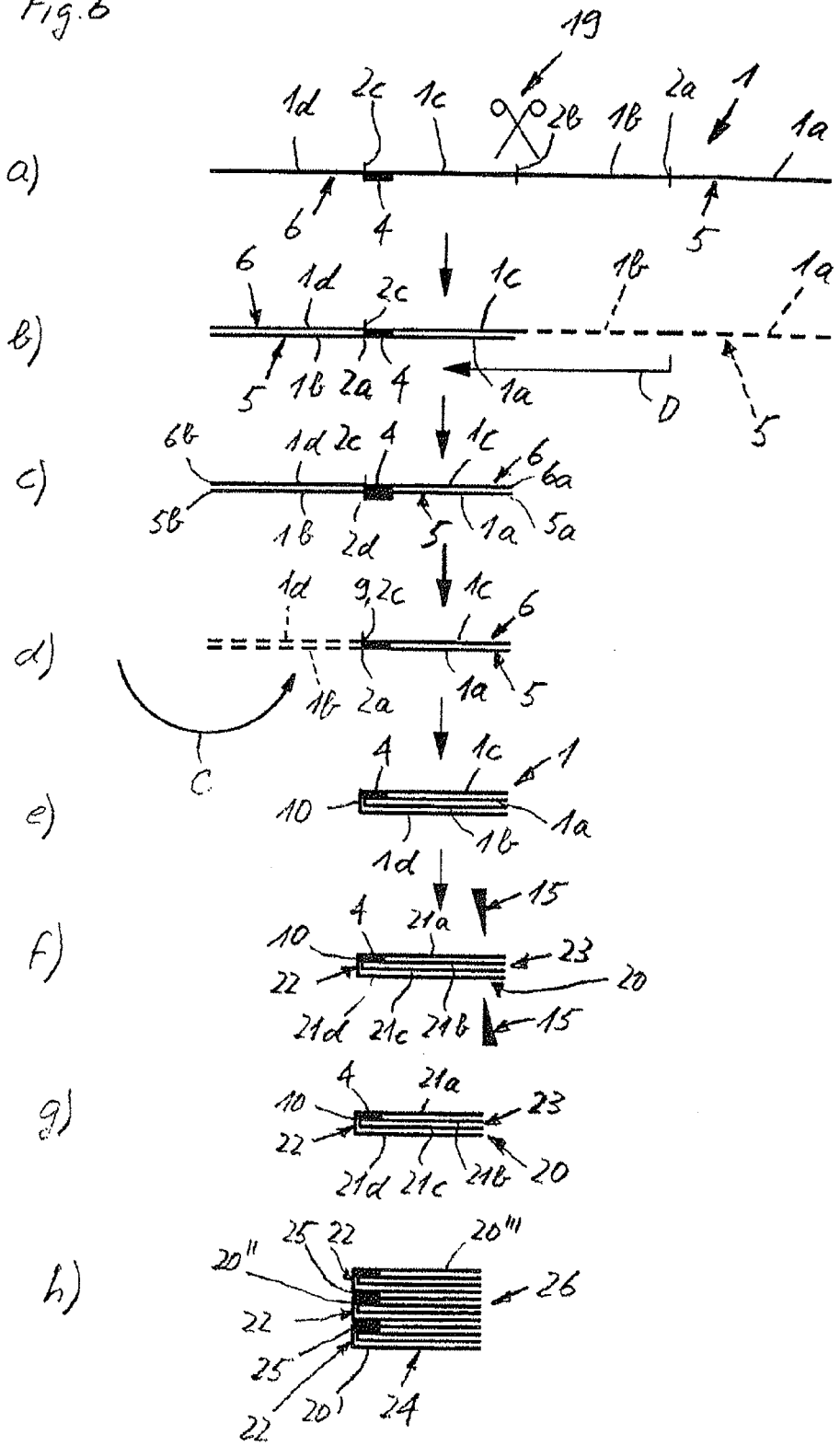
Figure 7:
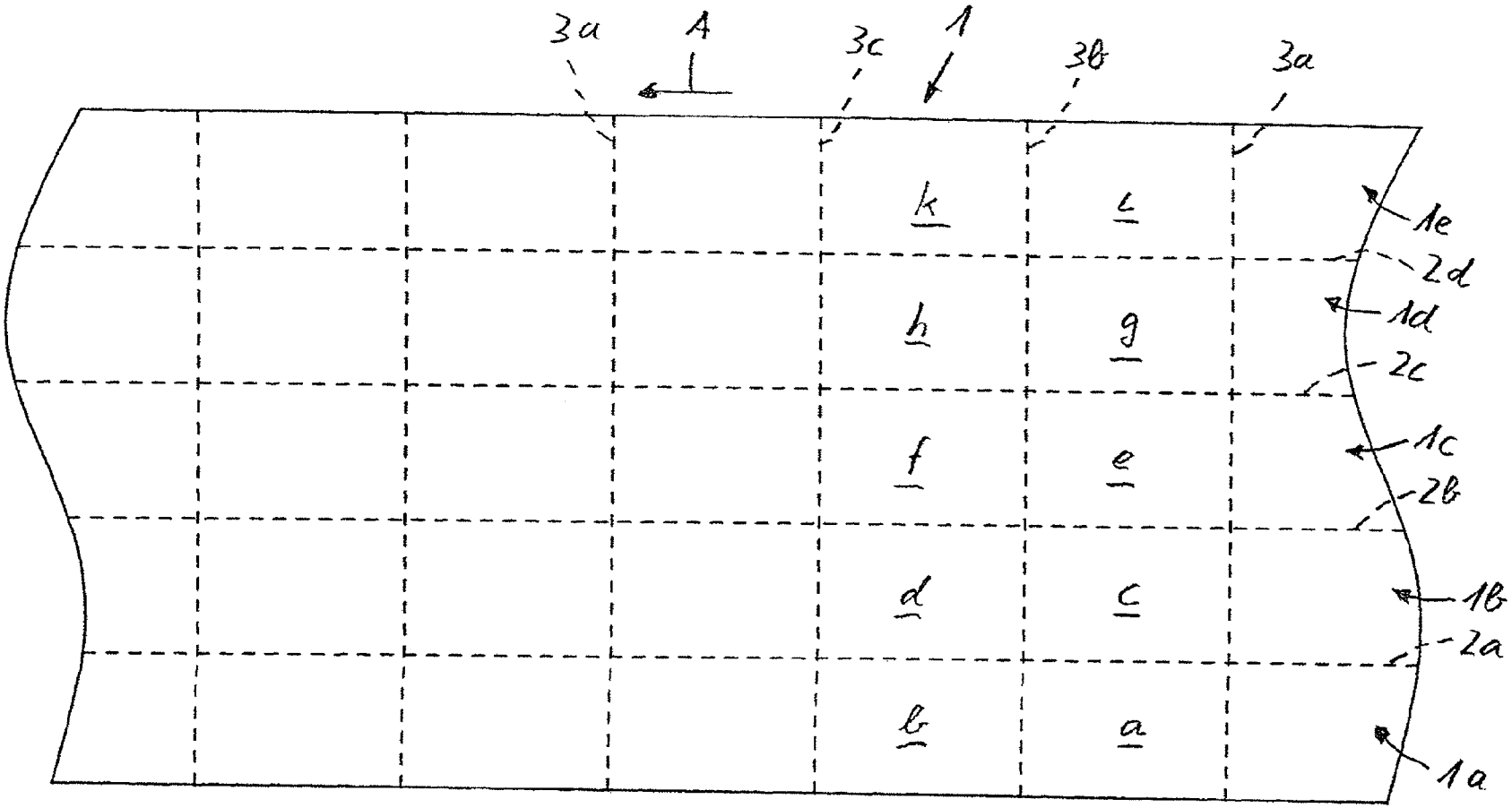
Figure 8:
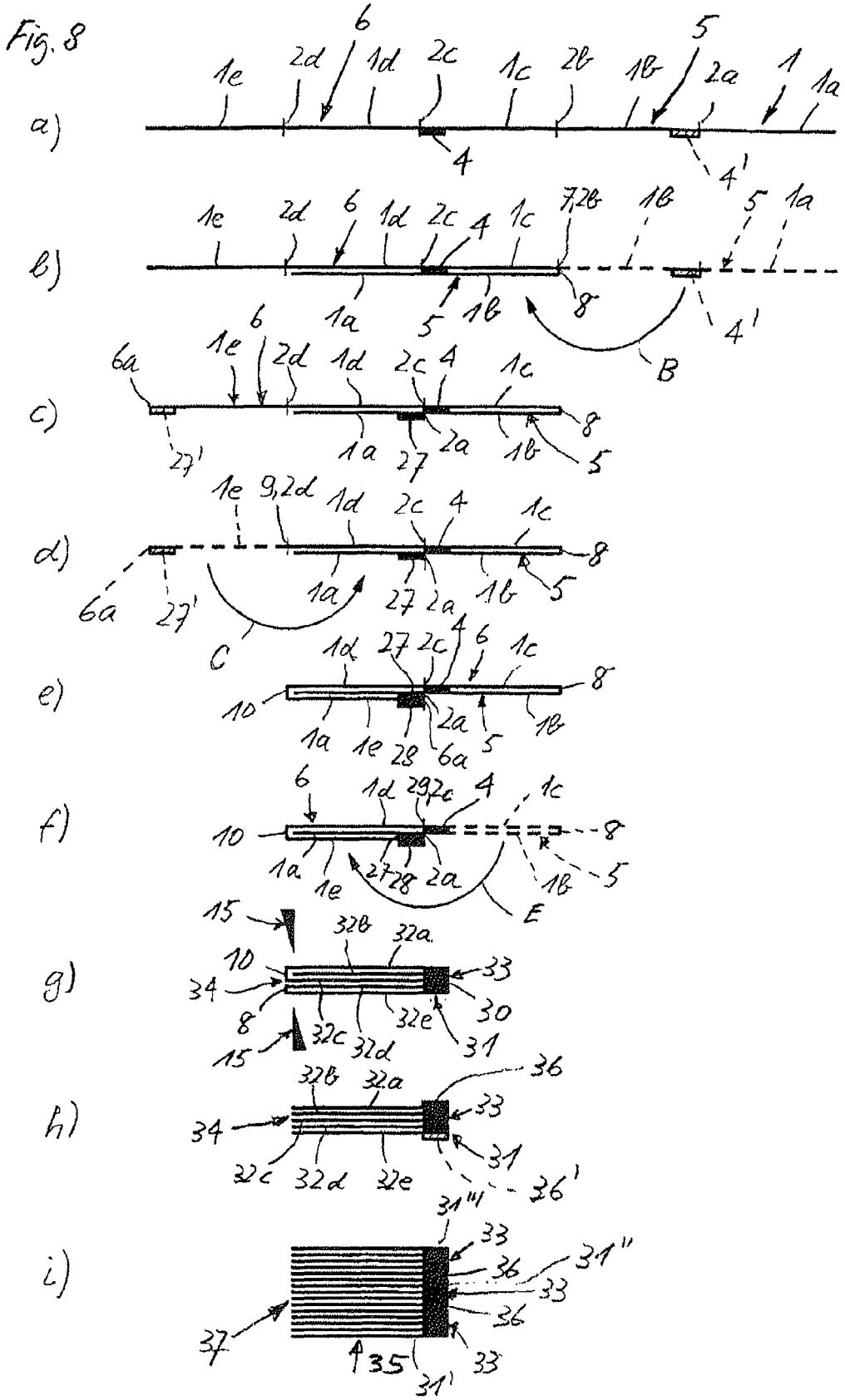
Figure 9:
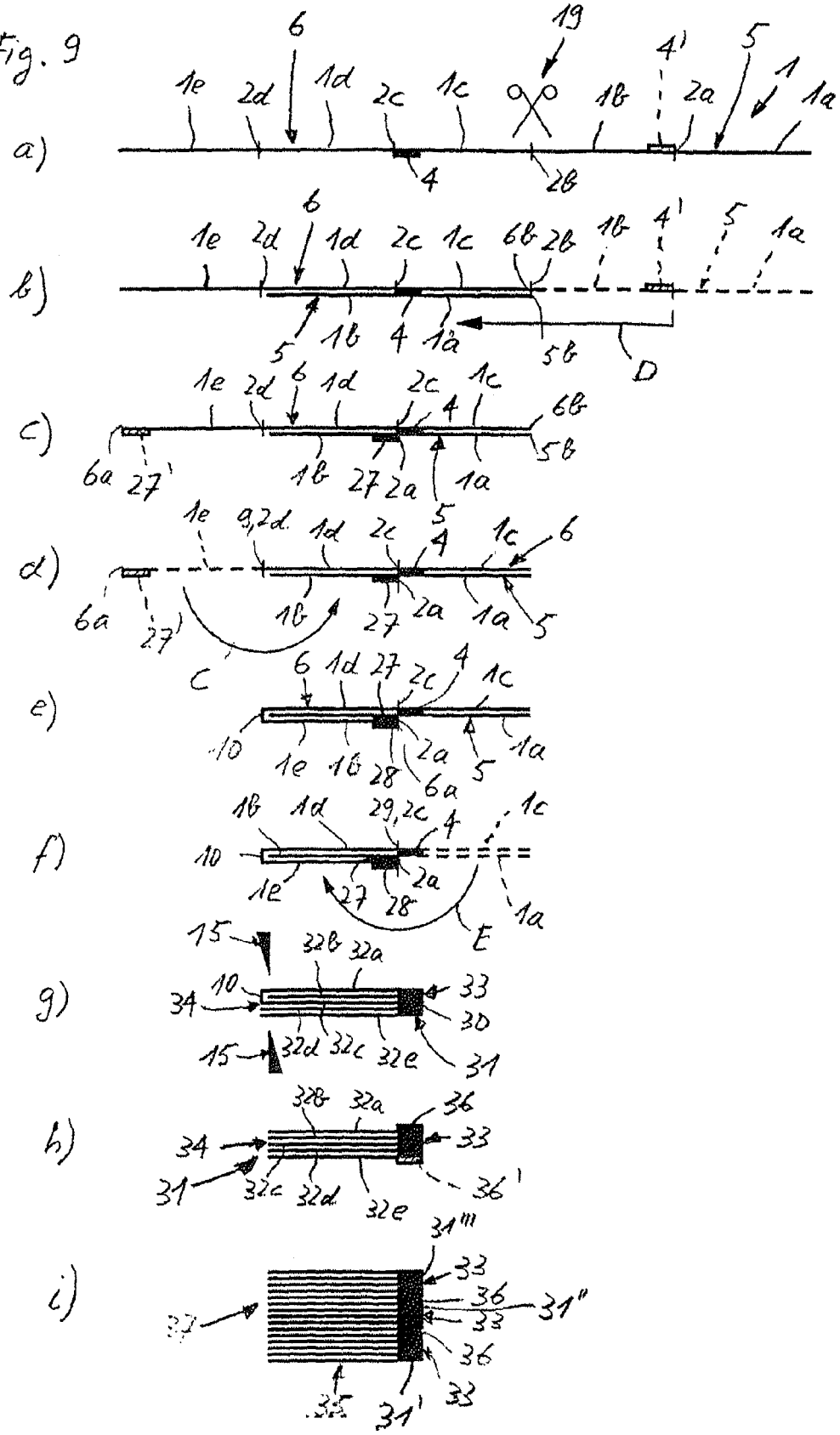

In the following text, the subject matter of the invention will be explained in greater detail using the figures, in which, purely diagrammatically:

FIG. 1 shows a plan view of a material web which is divided into three material web sections which are parallel to one another, FIG. 2 shows a first embodiment of the sequence of the method according to the invention, starting from the material web which is shown in FIG. 1, FIG. 3 shows a second embodiment of the sequence of the method according to the invention, starting from the material web which is shown in FIG. 1, FIG. 4 shows a plan view of a material web which is divided into four material web sections which are parallel to one another, FIG. 5 shows a first embodiment of the sequence of the method according to the invention, starting from the material web which is shown in FIG. 4, FIG. 6 shows a second embodiment of the sequence of the method according to the invention, starting from the material web which is shown in FIG. 4, FIG. 7 shows a plan view of a material web which is divided into five material web sections which are parallel to one another, FIG. 8 shows a first embodiment of the sequence of the method according to the invention, starting from the material web which is shown in FIG. 7, and FIG. 9 shows a second embodiment of the sequence of the method according to the invention, starting from the material web which is shown in FIG. 7.

A first exemplary embodiment of the sequence of the method according to the invention will now be explained using FIGS. 1 to 3.

As FIG. 1 shows, the material web 1 which is printed on both sides in a digital printing station has three printed material web sections 1*a*, 1*b*, 1*c* of the same width which are arranged next to one another. The delimitation between the material web sections 1*a*, 1*b* and 1*c* is indicated by way of dashed lines 2*a*, 2*b* which run in the longitudinal direction of the material web 1. Each material web section 1*a*, 1*b*, 1*c* is divided into sheets a, b; c, d and e, f, etc. of a printed product. The delimitation between the individual sheets of each material web section 1*a*, 1*b*, 1*c* in the longitudinal direction of the material web 1 is indicated by way of dashed lines 3*a*, 3*b*, 3*c*, 3*d*.

Using FIG. 2, starting from the material web 1 which is shown in FIG. 1, a first embodiment of the production method according to the invention will now be explained. FIGS. 2*a*-2*e* show the individual method steps in front views.

The material web 1 which comes from the digital printing station is moved forward in the direction of the arrow A (FIG. 1) which runs in the longitudinal direction of the material web 1. As FIG. 2*a* shows, an adhesive application 4 (adhesive track) which can be continuous or interrupted is applied to the underside of the material web 1 in the region of the delimitation line 2*b*. During the forward movement of the material web 1, a first material web part 5 which is formed by the material web section 1*a* is folded over about a line 7 which runs parallel to the advancing direction A and coincides with the delimitation line 2*a*, against a second material web part 6 which is formed by the two other material web sections 1*b*, 1*c*, as indicated by the arrow B in FIG. 2*b*. The second material web part 6 is twice as wide as the first material web part 5. Before the material web part 5 is folded over, the material web can be perforated along the folding line 7 if required. The first fold which is produced by the folding-over operation is denoted by 8. The folded-over material web part 5 is connected in the region of the line 2*b* to the other material web part 6 on the side edge 5*a* which lies opposite the fold 8 by means of the adhesive application 4 which is applied to said other material web part 6 (FIG. 2*b*).

In a second step, the material web section 1*c* of the other, wider material web part 6 is folded over about a line 9 which runs parallel to the advancing direction A and coincides with the delimitation line 2*b*, against the material web section 1*a* which was folded in the first step, as shown by way of the arrow C in FIG. 2*c*. The second fold which is produced in the process is denoted by 10. As FIG. 2*c* shows, the material web sections 1*c*, 1*a*, 1*b* lie above one another after this two-time folding operation of the material web 1. In a further step, sub-products 11 are now separated from said material web 1 which has been folded twice, along lines which run at right angles with respect to the advancing direction and coincide with the delimitation lines 3*a*, 3*b*, 3*c*, 3*d*, etc. (see FIG. 1).

A sub-product 11 of this type is shown in a front view in FIG. 2*d*. Each sub-product 11 consists of three sheets 12*a*, 12*b*, 12*c* which lie above one another and of which, before the separating, the sheet 12*a* was part of the material web section 1*b*, the sheet 12*b* was part of the material web section 1*a* and the sheet 12*c* was part of the material web section 1*c*. The sub-products 11 are trimmed on their side edge 14 which lies opposite the spine 13 which is formed by the fold 10, as is shown in FIG. 2*d* by way of the cutting tool 15 which is shown purely diagrammatically. In said sub-product 11, the sheets 12*a*, 12*b*, 12*c* are connected to one another in the spine 13, to be precise firstly via the fold 10 (sheets 12*a* and 12*c*) and secondly by means of the adhesive of the adhesive application 4 (sheets 12*a* and 12*b*).

Finally, a plurality of sub-products 11, that is to say at least three sub-products 11', 11", 11'" (FIG. 2*e*), are placed on one another to form a stack 16. Here, before or during the placing of the sub-products 11 on one another, an adhesive is applied to the upper side or underside of the sub-products 11 (adhesive application 17), to be precise in the region of the side edge which lies in the spine 13 of the sub-products 11. Said adhesive applications 17 can be continuous or interrupted or else also punctiform.

FIG. 2*e* shows a front view of a finished printed product (end product) 18 which has been produced in the above-described way. Said printed product 18 consists of the stacked sub-products 11', 11", 11'", of which each sub-product 11', 11", 11'" consists of three sheets 12*a*, 12*b*, 12*c*. Said sheets 12*a*, 12*b*, 12*c* are printed on both sides at least for the most part. The sub-products 11', 11", 11'" are connected permanently to one another in the region of their spine 13 by means of the adhesive of the adhesive applications 17. It goes without saying that no adhesive is applied on the upper side of the uppermost and on the underside of the lowermost sub-products 11' and 11'", respectively.

The finished printed product 18 does not require any further processing, since, as has been explained, firstly the sheets of each sub-product 11', 11", 11'" and secondly also the sub-products 11', 11", 11'" are already connected to one another. The open side edges of the sub-products 11', 11", 11'" and therefore also of the printed product 18 have already been trimmed during the course of the production process.

The stack 16 and therefore also the finished printed product 18 can also consist of more than three sub-products 11 which, as has been described, are connected to one another in the region of their spine 13.

Using FIG. 3 which corresponds in terms of illustration to FIG. 2, one variant of the production method which has been described in the preceding text with reference to FIG. 2 will now be explained.

This variant according to FIG. 3 differs from the embodiment according to FIG. 2 as a result of a different type of collation of the two material web parts 5 and 6. The same designations as in FIG. 2 are therefore used for features and parts which correspond to one another in FIG. 3.

In the variant according to FIG. 3, during the forward movement of the printed material web 1 which comes from the digital printing station, the first material web part 5 which is formed by the material web section 1*a* is not folded over against the second material web part 6 as in the method described using FIG. 2, but rather is separated from the other, second material web part 6 along a cutting line which is parallel to the advancing direction A and coincides with the delimitation line 2*a*, as symbolized in FIG. 3*a* by scissors 19. Subsequently, the material web part 5 which has been cut away is collated with the other, second material web part 6, as is indicated in FIG. 3*b* by way of the arrow D. The collation of the material web parts 5, 6 takes place in such a way that the two material web parts 5, 6 are aligned with one another along one of the side edges 5*a*, 6*a* and the material web sections 1*b* and 1*a* lie congruently above one another. At the same time, in the same way as in the embodiment according to FIG. 2, the first material web part 5 is connected along its other side edge 5*b* to the other, second material web part 6 by means of the adhesive of the adhesive application 4 (FIG. 3*b*).

If, in the same way as in the exemplary embodiment according to FIG. 2, the material web part 5 is to come into contact with its underside on the underside of the other material web part 6, the separated material web part 5 has to be turned before being collated with the other material web part 6. Turning of this type of the material web part 5 can also be dispensed with, however.

The further method steps which are shown in FIGS. 3*c*-*e* are identical to the method steps which are described using FIGS. 2*c*-*e*. Reference is therefore made to the description with respect to said FIGS. 2*c*-*e*.

Using FIGS. 4 to 6 which correspond in terms of illustration to FIGS. 1 to 3, a second exemplary embodiment of the sequence of the method according to the invention will now be explained.

As FIG. 4 shows, in this exemplary embodiment, the starting point is a material web 1 which is printed on both sides in a digital printing station and has four printed material web sections 1*a*, 1*b*, 1*c*, 1*d* of identical width which are arranged next to one another. The delimitation between the material web sections 1*a*, 1*b*, 1*c* and 1*d* is indicated by way of dashed lines 2*a*, 2*b*, 2*c* which run in the longitudinal direction of the material web 1. Each material web section 1*a*, 1*b*, 1*c*, 1*d* is divided into sheets a, b; c, d; e, f and g, h, etc. of a printed product. The delimitation between the individual sheets of each material web section 1*a*, 1*b*, 1*c*, 1*d* in the longitudinal direction of the material web 1 is indicated by way of dashed lines 3*a*, 3*b*, 3*c*, 3*d*.

Using FIG. 5, starting from the material web 1 which is shown in FIG. 4, a second embodiment of the production method according to the invention will now be explained. FIGS. 5*a*-5*h* show front views of the individual method steps.

The material web 1 which comes from the digital printing station is moved forward in the direction of the arrow A (FIG. 4) which runs in the longitudinal direction of the material web 1. As FIG. 5*a* shows, an adhesive application 4 (adhesive track) which can be continuous or interrupted has been applied to the underside of the material web 1 in the region of the delimitation line 2*c*. During the forward movement of the material web 1, a first material web part 5 which is formed by the material web sections 1*a* and 1*b* is folded over about a line 7 which runs parallel to the advancing direction A and coincides with the delimitation line 2*b*, against a second material web part 6 which is formed by the two other material web sections 1*c*, 1*d*, as indicated by way of the arrow B in FIG. 5*b*. The second material web part 6 is of identical width to the first material web part 5. Before the material web part 5 is folded over, the material web 1 can be perforated along the folding line 7 if required. The first fold which is produced by way of the folding-over operation is denoted by 8. The folded-over material web part 5 is connected to the other material web part 6 in the region of the line 2*c* by means of the adhesive application 4 which is applied to said other material web part 6 (FIG. 5*b*). The material web 1 which has been folded once in this way with the two material web parts 5, 6 which lie above one another and are connected to one another is shown in FIG. 5*c*.

In a second step, the material web sections 1*a* and 1*d* which lie above one another and belong in each case to one of the material web parts 6 and 5 are folded over about a line 9 which runs parallel to the advancing direction A and coincides with the delimitation lines 2*a* and 2*c*, against the two other material web sections 1*b* and 1*c* which lie above one another and belong in each case to one of the material web parts 6 and 5, as shown by way of the arrow C in FIG. 5*d*. The second fold which is produced in the process is denoted by 10 (FIG. 5*e*). The material web 1 which is folded twice in the above-described way is shown in FIG. 5*e*. As can be seen from said FIG. 5*e*, the material web sections 1*d*, 1*a*, 1*b* and 1*c* lie above one another in this sequence in said material web 1 which has been folded twice.

In a further step, sub-products 20 are now separated from said material web 1 which has been folded twice, along lines which run at right angles with respect to the advancing direction and coincide with the delimitation lines 3*a*, 3*b*, 3*c*, etc. (see FIG. 4). A sub-product 20 of this type is shown in a front view in FIG. 5*f*. Each sub-product 20 consists of four sheets 21*a*, 21*b*, 21*c*, 21*d* which lie above one another and of which, before the separation, the sheet 21*a* was part of the material web section 1*c*, the sheet 21*b* was part of the material web section 1*b*, the sheet 21*c* was part of the material web section 1*a* and the sheet 21*d* was part of the material web section 1*d*. On their side edge 23 which lies opposite the spine 22 which is formed by the fold 10, the sub-products 20 are trimmed, as shown in FIG. 5*f* by way of the cutting tool 15 which is shown purely diagrammatically.

FIG. 5*g* shows a trimmed sub-product 20 which is open both on its side edge 23 and on the two adjoining side edges which run at right angles with respect to the side edge 23. In said sub-product 20, the sheets 21*a*, 21*b*, 21*c*, 21*d* are connected to one another in the spine 22, to be precise firstly via the folds 8 and 10 and secondly by means of the adhesive of the adhesive application 4.

Finally, a plurality of sub-products 20, that is to say at least three sub-products 20', 20", 20'" (FIG. 5*h*), are placed on one another to form a stack 24. Here, before or during the placing of the sub-products 20 on one another, an adhesive is applied to the upper side or underside of the sub-products 20 (adhesive application 25), to be precise in the region of the side edge which lies in the spine 22 of the sub-products 20. Said adhesive applications 25 can be continuous or interrupted or else also punctiform.

FIG. 5*h* shows a front view of a finished printed product (end product) 26 which has been produced in the above-described way. Said printed product 26 consists of the stacked sub-products 20', 20", 20'", of which, as has already been mentioned and is shown in FIG. 5*f*, each sub-product 20', 20", 20'" consists of four sheets 21*a*, 21*b*, 21*c*, 21*d* which are printed on both sides at least for the most part. The sub-products 20', 20", 20'" are connected permanently to one another in the region of their spine 22 by means of the adhesive of the adhesive applications 25. It goes without saying that no adhesive is applied on the upper side of the uppermost and on the underside of the lowermost sub-product 20' and 20'", respectively.

A finished printed product 26 also does not require any further processing in this exemplary embodiment, since, as has been explained, firstly the sheets of each sub-product 20', 20", 20'" and secondly also the sub-products 20', 20", 20'" are already connected to one another. The open side edges of the sub-products 20', 20", 20'" and therefore also of the printed product 26 have already been trimmed during the course of the production process.

The stack 24 and therefore also the finished printed product 26 can also consist of more than three sub-products 20 which, as has been described, are connected to one another in the region of their spine 22.

Using FIG. 6 which corresponds in terms of illustration to FIG. 5, one variant of the production process which has been described above in relation to FIG. 5 will now be explained.

This variant according to FIG. 6 differs from the embodiment according to FIG. 5 as a result of a different type of collation of the two material web parts 5 and 6. The same designations as in FIG. 5 are therefore used for features and parts which correspond to one another in FIG. 6.

In the variant according to FIG. 6, during the forward movement of the printed material web 1 which comes from the digital printing station, the first material web part 5 which is formed by the two material web sections 1*a* and 1*b* is not folded over against the second material web part 6 as in the method which was described using FIG. 5, but rather is separated from the other, second material web part 6 along a cutting line which is parallel to the advancing direction A and coincides with the delimitation line 2*b*, as is symbolized in FIG. 6*a* by scissors 19. Subsequently, the material web part 5 which has been cut away is collated with the other, second material web part 6, as is indicated in FIG. 6*b* by way of the arrow D. The collation of the material web parts 5, 6 takes place in such a way that the two material web parts 5, 6 are aligned with one another along their side edges 5*a*, 6*a* and 5*b*, 6*b* and the two material web parts 5 and 6 lie congruently above one another (FIG. 6*b*). At the same time, in the same way as in the embodiment according to FIG. 5, the first material web part 5 is connected to the other, second material web part 6 by means of the adhesive of the adhesive application 4 in the region of the line 2*c* (FIG. 6*c*).

The further method steps which are shown in FIGS. 6*d-h* are the same as the method steps described using FIGS. 5*d-h*. Reference is therefore made to the description with respect to said FIGS. 5*d-h*. It is to be noted here, however, that the sequence of the material web sections 1*a*-1*d* which lie in each case above one another in FIGS. 6*d-h* is different than shown in FIGS. 5*d-h*. If there is also a desire in the variant according to FIG. 6 that, as shown in FIG. 5*b*, the material web sections 1*b*, 1*c* and 1*a*, 1*d* come to lie above one another, the separated material web part 5 has to be turned before collation with the other material web part 6. Turning of this type of the material web part 5 can also be dispensed with, however.

Using FIGS. 7-9 which correspond in terms of illustration to FIGS. 1-3 and 4-6, a third exemplary embodiment of the sequence of the method according to the invention will now be explained.

As FIG. 7 shows, in this exemplary embodiment, the starting point is a material web 1 which is printed on both sides in a digital printing station and has five printed material web sections 1*a*, 1*b*, 1*c*, 1*d*, 1*e* of identical width which are arranged next to one another. The delimitation between the material web sections 1*a*, 1*b*, 1*c*, 1*d* and 1*e* is indicated by way of dashed lines 2*a*, 2*b*, 2*c*, 2*d* which run in the longitudinal direction of the material web 1. Each material web section 1*a*, 1*b*, 1*c*, 1*d*, 1*e* is divided into sheets a, b; c, d; e, f; g, h and i, k, etc. of a printed product. The delimitation between the individual sheets of each material web section 1*a*, 1*b*, 1*c*, 1*d*, 1*e* in the longitudinal direction of the material web 1 is indicated by way of dashed lines 3*a*, 3*b*, 3*c*, 3*d*.

Using FIG. 8, starting from the material web 1 which is shown in FIG. 7, a third embodiment of the production method according to the invention will now be explained. FIGS. 8*a*-8*i* show front views of the individual method steps.

The material web 1 which comes from the digital printing station is moved forward in the direction of the arrow A (FIG. 7) which runs in the longitudinal direction of the material web 1. As FIG. 8*a* shows, an adhesive application 4 (adhesive track) which can be continuous or interrupted has been applied to the underside of the material web 1 in the region of the delimitation line 2*c*. During the forward movement of the material web 1, a first material web part 5 which is formed by the material web sections 1*a* and 1*b* is folded over about a line 7 which runs parallel to the advancing direction A and coincides with the delimitation line 2*b*, against a second material web part 6 which is formed by the three other material web sections 1*c*, 1*d*, 1*e*, as indicated by way of the arrow B in FIG. 8*b*. The second material web part 6 is wider than the first material web part 5. Before the material web part 5 is folded over, the material web 1 can be perforated along the folding line 7 if required. The first fold which was produced by the folding-over operation is denoted by 8. The folded-over material web part 5 is connected to the other material web part 6 in the region of the line 2*c* by means of the adhesive application 4 which is applied to said other material web part 6 (FIG. 8*b*). The material web 1 which has been folded once in this way with the two material web parts 5, 6 of unequal width which lie above one another and are connected to one another is shown in FIG. 8*c*.

As FIG. 8*c* shows further, a further adhesive application 27 (adhesive track) which can be continuous or interrupted is now applied to the underside of the folded-over material web part 5, that is to say to the underside of the material web section 1*a*, in the region of the delimitation line 2*a* (which is aligned with the line 2*c*).

In a second folding step, the material web section 1*e* of the wider material web part 6 is folded over about a line 9 which runs parallel to the advancing direction A and coincides with the delimitation line 2*d*, against the material web part 5 which was folded over in the first folding step, as shown by way of the arrow C in FIG. 8*d*. The second fold which is produced in the process is denoted by 10 (FIG. 8*e*). The folded-over material web section 1*e* is connected to the material web section 1*a* in the region of the line 2*a* on the side edge 6*a* which lies opposite the fold 10 by means of the adhesive application 27 which is applied to said material web section 1*a* (FIG. 8*e*). The material web 1 which has been folded twice in the above-described way is shown in FIG. 8*e*. As can be seen from said FIG. 8*e*, in said material web 1 which has been folded twice, firstly the two material web sections 1*b* and 1*c* and secondly the three material web sections 1*e*, 1*a*, 1*b* lie above one another in this sequence.

As is further apparent from FIG. 8*e*, a third adhesive application 28 (adhesive track) which can be continuous or interrupted is applied to the underside of the folded-over material web section 1*e* in the region of its side edge 6*a* (which is aligned with the delimitation line 2*a*, 2*c*).

In a third step (shown in FIG. 8*f*), the two material web sections 1*b*, 1*c* which lie above one another are folded over about a line 29 which runs parallel to the advancing direction A and coincides with the delimitation lines 2*a* and 2*c*, against the three other material web sections 1*e*, 1*a*, 1*d* which lie above one another, as is shown by way of the arrow E in FIG. 8*f*. The third fold which is produced in the process is denoted by 30 (FIG. 8*g*).

Sub-products 31 are now separated from said material web 1 which has been folded three times, in a further step along lines which run at right angles with respect to the advancing direction and coincide with the delimitation lines 3*a*, 3*b*, 3*c*, 3*d*, etc. (see FIG. 7). A sub-product 31 of this type is shown in a front view in FIG. 8*g*. Each sub-product 31 consists of five sheets 32*a*, 32*b*, 32*c*, 32*d*, 32*d* which lie above one another, of which, before the separation, the sheet 32*a* was part of the material web section 1*d*, the sheet 32*b* was part of the material web section 1*a*, the sheet 32*c* was part of the material web section 1*e*, the sheet 32*d* was part of the material web section 1*b* and the sheet 32*e* was part of the material web section 1*c*. On their side edge 34 which lies opposite the spine 33 which is formed by the fold 30, the sub-products 31 are trimmed, as is shown in FIG. 8*g* by way of the cutting tool 15 which is shown purely diagrammatically.

FIG. 8*h* shows a trimmed sub-product 31 which is open both on its side edge 34 and also on the two adjoining side edges which run at right angles with respect to the side edge 34. In said sub-product 31, the sheets 32*a*, 32*b*, 32*c*, 32*d*, 32*e* are connected to one another in the spine 33, to be precise firstly via the fold 30 and secondly by means of the adhesive of the adhesive applications 4, 27, 28.

Finally, a plurality of sub-products 31, that is to say at least three sub-products 31', 31", 31'" (FIG. 8*i*), are placed on one another to form a stack 35. Here, before or during the placing of the sub-products 31 on one another, an adhesive is applied to them (adhesive application 36), to be precise in the region of the side edge which lies in the spine 33 of the sub-products 31. Said adhesive applications 36 can be continuous or interrupted or else also punctiform. As FIG. 8*h* shows, the adhesive application can be applied either on the upper side (adhesive application 36) or else also on the underside (adhesive application 36') of the sub-products 31. It goes without saying that no adhesive is applied on the upper side of the uppermost and on the underside of the lowermost sub-product 31''' and 31', respectively.

FIG. 8*i* shows a front view of a finished printed product (end product) 37 which has been produced in the above-described way. Said printed product 37 consists of the stacked sub-products 31', 31'', 31''', of which, as has already been mentioned and is shown in FIG. 8*h*, each sub-product 31', 31'', 31''' consists of five sheets 32*a*, 32*b*, 32*c*, 32*d*, 32*e* which are printed on both sides at least for the most part. The sub-products 31', 31'', 31''' are connected permanently to one another in the region of their spine 33 by means of the adhesive of the adhesive applications 36.

A finished printed product 37 also does not require any further processing in this exemplary embodiment, since, as has been explained, firstly the sheets of each sub-product 31', 31'', 31''' and secondly also the sub-products 31', 31'', 31''' are already connected to one another. The open side edges of the sub-products 31', 31'', 31''' and therefore also of the printed product 37 have already been trimmed during the course of the production process.

The stack 35 and therefore also the finished printed product 37 can also consist of more than three sub-products 31 which, as has been described, are connected to one another in the region of their spine 33.

The adhesive applications 4 and 27 can also be applied at a different location to that shown in the region of the delimitation line 2*c* (adhesive application 4) and in the region of the delimitation line 2*a* (adhesive application 27). Alternative locations for applying the adhesive for the adhesive applications 4 and 27 are shown in FIGS. 8*a-d*.

As is apparent from FIGS. 8*a*, 8*b*, it is also possible to apply the adhesive application 4 in the region of the delimitation line 2*a* to the underside of the material web section 1*b*. An adhesive application of this type is denoted by 4'.

As shown in FIGS. 8*c*, 8*d*, the adhesive application 27 can be applied in the region of the side edge 6*a* of the material web section 1*e* to the underside of said material web section 1*e*. An adhesive application of this type is denoted by 27'.

It goes without saying that, in the embodiments which have been described in FIGS. 2, 3 and 5, 6, the adhesive application 4 can also be applied at another suitable location (according to the alternative explained in the above text using FIG. 8 (adhesive application 4')).

Using FIG. 9 which corresponds in terms of illustration to FIG. 8, one variant of the production method which has been described in the preceding text with reference to FIG. 8 will now be explained.

This variant according to FIG. 9 differs from the embodiment according to FIG. 8 as a result of a different type of collation of the two material web parts 5 and 6. The same designations as in FIG. 8 are therefore used for features and parts which correspond to one another in FIG. 9.

In the variant according to FIG. 9, during the forward movement of the printed material web 1 which comes from the digital printing station, the first material web part 5 which is formed by the two material web sections 1*a* and 1*b* is not folded over against the second material web part 6 as in the method described using FIG. 8, but rather is separated from the other, second material web part 6 along a cutting line which is parallel to the advancing direction A and coincides with the delimitation line 2*b*, as is symbolized in FIG. 9*a* by scissors 19. Subsequently, the material web part 5 which has been cut away is collated with the other, second material web part 6, as is indicated in FIG. 9*b* by way of the arrow D. The collation of the material web parts 5, 6 takes place in such a way that the two material web parts 5, 6 are aligned with one another along their side edge 5*b*, 6*b* and in each case the two material web sections 1*a*, 1*c* and 1*b*, 1*d* of the two material web parts 5 and 6 lie congruently above one another (FIG. 9*b*). At the same time, in the same way as in the embodiment according to FIG. 8, the first material web part 5 is connected to the other, second material web part 6 by means of the adhesive of the adhesive application 4 in the region of the line 2*c* (FIG. 9*c*).

The further method steps (shown in FIGS. 9*c-i*) are the same as the method steps which were described using FIGS. 8*c-i*. Reference is therefore made to the description with respect to said FIGS. 8*c-i*. It is to be noted here, however, that the sequence of the material web sections 1*a*-1*e* which lie in each case above one another in FIGS. 9*b*-9*f* is different than that shown in FIGS. 8*b*-8*f*. If there is also a desire in the variant according to FIG. 9 that, as shown in FIG. 8*a*, the material web sections 1*b*, 1*c* and 1*a*, 1*d* come to lie above one another, the separated material web part 5 has to be turned before collation with the other material web part 6. Turning of this type of the material web part 5 can also be dispensed with, however.

It is to be noted, furthermore, that, in the variant which is shown in FIG. 9, the adhesive of the adhesive application 4' is applied to the upper side of the material web section 1*b* (FIGS. 9*a*, 9*b*) and not, as shown in FIGS. 8*a*, 8*b*, to the underside of the material web section 1*b*.

In one variant with respect to the production methods which are shown in FIGS. 8 and 9, the first material web part 5 is formed only by the one material web section 1*a*. Said first material web part 5 is then, as shown in FIGS. 8*a, b* and 9*a, b*, collated with the other, second material web part 6 and is connected to said second material web part 6 by means of an adhesive application 4 in the region of the delimitation line 2*a* or 2*b*. Subsequently, first, central folding of the second material web part 6 including the first material web part 15 which is connected to it takes place about a folding line which coincides with the delimitation line 2*c*, and then second, central folding takes place about a folding line which coincides with the delimitation line 2*d*. The folded-over material web sections 1*a-e* are connected to one another by means of an adhesive as far as necessary during the first and second folding, in such a way that, in the finished sub-product 31, its sheets 32*a-e* are connected to one another in the spine 33 of said sub-product 31.

In one alternative, the material web part 5 which has been separated according to FIG. 9*a* (material web section 1*a*) is collated and connected to one of the material web sections 1*c*, 1*d* or 1*e*, before, as has been described, the two-time folding and connecting by means of the adhesive take place.

In the way which is described using FIGS. 1-3, 4-6 or 7-9, starting from a material web which has 6, 8 or 10 printed material web sections, respectively, which are arranged next to one another in the longitudinal direction thereof, sub-products can be produced which correspondingly consist of 6, 8 or 10 sheets, respectively, which are printed on both sides and which are stacked, as has been described, to form finished printed products.

In the following text, reference will also be made to further variants of the production methods which have been described in the above text.

Instead of trimming the sub-products 11, 20, 31, as described using FIGS. 2, 3; 5, 6 and 8, 9, before the stacking on their side edge 14, 23 or 34 which lies opposite the spine 13, 22 or 33 (front trimming), said front trimming can also take place on the finished stacks 16, 24 or 35, that is to say in the case of sub-products 11, 20 or 31 which are placed on one another. Together with said front trimming, the remaining side edges which run at right angles with respect to the spine 13, 22, 33 of the sub-products 11, 20, 31 can also be trimmed if required.

FIGS. 2, 3; 5, 6 and 8, 9 show the adhesive applications 4, 27, 28 in such a way that they adjoin an associated delimitation line 2*a*, 2*b* or 2*c*, respectively, or the side edge 6*a*. The adhesive applications 4, 27, 28 which are applied to the material web 1 or its sections 1*a-e* can also, however, assume a somewhat different position to that shown in the figures with regard to the associated delimitation line. Furthermore, the adhesive of said adhesive applications 4, 27, 28 can be applied from below, from above, from the side or in another suitable way to the material web 1 or its parts 5, 6 (see FIGS. 8 and 9).

It goes without saying that, in the case of all the described exemplary embodiments and variants, the material web 1 has to be printed in the digital printing station in such a way that the pages of the finished printed product 18, 26 and 37 which are printed onto the sheets 12*a-c*, 21*a-d*, 32*a-e* of each sub-product 11, 20, 31 are arranged in the correct sequence. This is achieved by way of corresponding preparation of the printing data for the digital printing station.

In the case of all the exemplary embodiments which are shown, the folding over of material web parts and sections takes place in a downward manner (that is to say, in the direction of the arrows A, B, E). However, it is also possible in principle to fold over the material web parts and sections in an upward manner (counter to the direction of the arrows A, B, E). In this alternative, the adhesive applications 4, 27, 28 would of course have to be applied correspondingly at different locations.

The invention claimed is:

1. A method for producing printed products, which consist of at least three multiple-sheet sub-products which lie on one another and are connected to one another, in which method, in the case of a material web which is printed in a digital printing station, is moved in an advancing direction and has at least three printed material web sections which are arranged next one another in the longitudinal direction thereof, a first material web part which is formed by at least one material web section is collated in a first step with the remaining material web part which is formed from at least one other material web section, and the two material web parts are connected to one another by means of an adhesive in the region of a connecting line which runs in the longitudinal direction of the material web and between two adjacent material web sections, wherein in a following second step, the material web is folded once or multiple times along in each case one line which is parallel to the advancing direction of the material web and runs between two adjacent material web sections, in such a way that all material web sections come to lie above one another, in that, subsequently, multiple-sheet sub-products, the sheets of which are connected to one another in the region of the spine of the respective sub-products, are separated from the material web by way of cutting transversely with respect to the advancing direction of said material web, and in that the sub-products are placed on one another in order to form a stack, the stacked sub-products being connected to one another by means of an adhesive which is applied, before or during the placing of the sub-products on one another, to the upper side or underside of the sub-products in a manner which is adjacent to the side edges which lie in the spine of a sub-product.

2. The method as claimed in claim 1, wherein, in order to collate the material web parts, in the first step the first material web part is folded about a line which is parallel to the advancing direction of the material web and runs between two adjacent material web sections.

3. The method as claimed in claim 1, wherein, in order to collate the material web parts, in the first step the first material web part is separated along a line which is parallel to the advancing direction of the material web and runs between two adjacent material web sections, and that the two material web parts are subsequently placed above one another.

4. The method as claimed in claim 1, wherein in the first step, the two material web parts are connected to one another in the region of a connecting line which later comes to lie in the spine of the sub-products.

5. The method as claimed in claim 1, wherein in the case of a material web which has an odd number of material web sections which are arranged next to one another, one of the two material web parts which are collated in the first step is formed at least by a material web section and the other of the material web parts is formed by at least two material web sections.

6. The method as claimed in claim 5, wherein, in the case of a material web which has three material web sections which are arranged next to one another, in the first step the two material web parts are connected to one another in the region of a connecting line which runs between the two material web sections of the one material web part.

7. The method as claimed in claim 6, wherein, in the first step, the first material web part which has a material web section is placed onto a first of the two material web sections of the other, second material web part and is connected to the latter by means of the adhesive, and in that, in the second step, the other, second material web section of the second material web part is folded along the line which runs between the two material web sections of the second material web part, in such a way that all three material web sections come to lie above one another.

8. The method as claimed in claim 7, wherein sub-products are separated from the material web which has three material web sections which lie above one another and are connected to one another, which sub-products are formed from three sheets which are connected to one another.

9. The method as claimed in claim 5, wherein in the case of a material web which has five material web sections which are arranged next to one another, in the first step the first material web part which has at least one material web section is placed onto the other, second material web part, and the material web sections which lie on one another of the two material web parts are connected to one another by means of the adhesive in the region of a connecting line, and in that subsequently a first fold of material web sections takes place about a folding line which coincides with a connecting line and then a second fold of material web sections takes place about another folding line which coincides with another connecting line, with the result that all material web sections come to lie above one another, the folded-over material web sections being connected to one another by means of an adhesive during the first and second fold in such a way that, in the finished sub-product, the sheets thereof are connected to one another in the spine of said sub-product.

10. The method as claimed in claim 9, wherein, in the first step, the first material web part which has two material web sections is placed onto two of the three material web sections of the other, second material web part, and the material web sections which lie on one another of the two material web parts are connected to one another by means of the adhesive in the region of a connecting line which runs between the two material web sections which lie above one another of the two material web parts, in that, in the second step, the third material web section of the second material web part is folded along the line which lies between it and the adjoining material web section of the second material web part, in such a way that said third material web section comes to lie on two material web sections which lie above one another and belong in each case to the first and second material web part, and in that said third material web section is connected by means of an adhesive, in the region of its side edge which is parallel to the folding line, to the material web sections which are placed on one another in the first step.

11. The method as claimed in claim 10, wherein, in a further, subsequent step, the material web, half of which consists of three material web sections which lie on one another and the other half of which consists of two material web sections which lie on one another, is folded along the center line which runs in its advancing direction, with the result that all five material web sections come to lie above one another.

12. The method as claimed in claim 11, wherein the two material web halves which are folded onto one another are connected to one another by means of an adhesive in the region of the folding edge.

13. The method as claimed in claim 11, wherein sub-products are separated from the material web which has five material web sections which lie above one another and are connected to one another, which sub-products are formed from five sheets which are connected to one another.

14. The method as claimed in claim 9, wherein, in the first step, the first material web part which has one material web section is placed onto one of the four material web sections of the other, second material web part, and the material web sections which lie on one another of the two material web parts are connected to one another by means of the adhesive in the region of a connecting line which runs between two adjacent material web sections of the two material web parts, and in that subsequently the second material web part, including the first material web part which is connected to it, is folded twice one after another, centrally about in each case one line which runs between two adjacent material web sections of the second material web part.

15. The method as claimed in claim 1, wherein in the case of a material web which has an even number of material web sections which are arranged next to one another, both of the material web parts which are collated in the first step are equally wide and are formed in each case by at least two material web sections.

16. The method as claimed in claim 15, wherein, in the case of a material web which has four material web sections which are arranged next to one another, in the first step the first material web part which has two material web sections is placed congruently onto the second material web part which likewise has two material web sections, and the material web sections which are placed on one another of the two material web parts are connected to one another by means of the adhesive in the region of a connecting line which runs between the two material web sections of the two material web parts which lie above one another, in that, in the second step, the material web sections which lie on one another and belong in each case to the first and second material web part are folded along their center line which runs in the advancing direction of the material web, in such a way that all four material web sections come to lie above one another.

17. The method as claimed in claim 16, wherein sub-products are separated from the material web which has four material web sections which lie above one another and are connected to one another, which sub-products are formed from four sheets which are connected to one another.

18. The method as claimed in claim 1, wherein the sub-products are trimmed on their side edge which lies opposite the spine.

19. The method as claimed in claim 18, wherein the sub-products are trimmed before they are placed on one another to form a stack.

20. The method as claimed in claim 18, wherein the sub-products are trimmed after being placed on one another to form a stack.

21. The method as claimed in claim 1, wherein the material web is printed on both sides in the digital printing station.

22. A printed product produced in accordance with the method as claimed in claim 1, consisting of at least three multiple-sheet sub-products which lie on one another, are connected to one another in a manner which is adjacent to the side edge which lies in the spine of the sub-products and which each comprise at least three printed sheets, and are connected to one another in the spine of the associated sub-product either by adhesive bonding or via a fold.

23. The printed product as claimed in claim 22, wherein the sub-products are trimmed on their side edge which lies opposite the spine.

24. The printed product as claimed in claim 22, wherein at least part of the sheets of each sub-product are printed on both sides.

* * * * *